US011067299B2

(12) United States Patent
Henderson et al.

(10) Patent No.: US 11,067,299 B2
(45) Date of Patent: Jul. 20, 2021

(54) PACKAGED TERMINAL AIR CONDITIONER UNIT WITH AN INLET CONDUIT HOOKED AROUND AN OUTLET CONDUIT

(71) Applicant: Haier US Appliance Solutions, Inc., Wilmington, DE (US)

(72) Inventors: Richard Dustin Henderson, LaGrange, KY (US); Robert William Jewell, Louisville, KY (US); Tal Abraham Ohayon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 162 days.

(21) Appl. No.: 15/908,907

(22) Filed: Mar. 1, 2018

(65) Prior Publication Data

US 2019/0271476 A1 Sep. 5, 2019

(51) Int. Cl.

| | |
|---|---|
| ***F24F 1/027*** | (2019.01) |
| ***F24F 13/20*** | (2006.01) |
| ***F24F 1/0326*** | (2019.01) |

(52) U.S. Cl.

CPC ..... *F24F 1/027* (2013.01); *F24F 1/0326* (2019.02); *F24F 13/20* (2013.01); *F25B 2500/12* (2013.01); *F25B 2500/13* (2013.01)

(58) Field of Classification Search

CPC .. F24F 1/12; F24F 2013/202; F24F 2013/245; F24F 13/24; F24F 13/20; F24F 1/26; F24F 1/30; F24F 1/32; F24F 1/10; F24F 1/0326; F25B 41/003; F25B 2500/01; F25B 2500/12; F25B 2500/13; F04B 39/0055; F04B 39/0072

See application file for complete search history.

(56) References Cited

U.S. PATENT DOCUMENTS

| | | | | |
|---|---|---|---|---|
| 7,000,421 B2 | 2/2006 | Lee et al. | | |
| 7,124,599 B2 * | 10/2006 | Jung | ..... | F25B 41/003 62/296 |

FOREIGN PATENT DOCUMENTS

| | | | | | |
|---|---|---|---|---|---|
| CN | 203375571 U | | 1/2014 | | |
| JP | 59167641 A | * | 9/1984 | ..... | F24F 1/10 |
| JP | 06117729 A | * | 4/1994 | ..... | F25B 31/00 |
| WO | WO-2013040670 A1 | * | 3/2013 | ..... | F24F 13/24 |

* cited by examiner

*Primary Examiner* — Tavia Sullens

(74) *Attorney, Agent, or Firm* — Dority & Manning, P.A.

(57) ABSTRACT

A packaged terminal air conditioner unit includes an inlet conduit coupled to a compressor at an accumulator of the compressor. An outlet conduit is coupled to the compressor at a discharge of the compressor. The discharge of the compressor is positioned at a top portion of the compressor. The outlet conduit extends upwardly along a vertical direction from the discharge of the compressor between a pair of angled segments of the inlet conduit. The pair of angled segments of the inlet conduit is positioned above the compressor along the vertical direction.

7 Claims, 5 Drawing Sheets

PACKAGED TERMINAL AIR CONDITIONER UNIT WITH AN INLET CONDUIT HOOKED AROUND AN OUTLET CONDUIT

FIELD OF THE INVENTION

The present subject matter relates generally to packaged terminal air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. Generally, one-unit type air conditioner units include an indoor portion and an outdoor portion. The indoor portion is generally located indoors, and the outdoor portion is generally located outdoors. Accordingly, the air conditioner unit generally extends through a wall, window, etc. of the structure.

Within certain one-unit type air conditioner units, a rotary compressor is coupled to a suction conduit and a discharge conduit. In particular, FIG. 3 shows a rotary compressor 50 coupled to a suction conduit 60 and a discharge conduit 70 within a known one-unit type air conditioner unit 10. Collectively, the rotary compressor 50, suction conduit 60 and discharge conduit 70 form a rotational vibration system within the known one-unit type air conditioner unit 10 that resonates at a frequency proportional to the square root of the torsional spring constant divided by the mass moment of inertia, where the torsional spring constant is at least partially defined by the lengths and orientations of the suction conduit 60 and discharge conduit 70. In particular, the rotational vibration system within the known one-unit type air conditioner unit 10 may resonate when the rotary compressor 50 operates at about twenty-five hundred rotations per minute (~2500 RPM). This may disadvantageously cause the known one-unit type air conditioner unit 10 to operate relatively loudly when the rotary compressor 50 operates around such speed.

BRIEF DESCRIPTION OF THE INVENTION

The present subject matter provides a packaged terminal air conditioner unit that includes an inlet conduit coupled to a compressor at an accumulator of the compressor. An outlet conduit is coupled to the compressor at a discharge of the compressor. The discharge of the compressor is positioned at a top portion of the compressor. The outlet conduit extends upwardly along a vertical direction from the discharge of the compressor between a pair of angled segments of the inlet conduit. The pair of angled segments of the inlet conduit is positioned above the compressor along the vertical direction. Additional aspects and advantages of the invention will be set forth in part in the following description, or may be apparent from the description, or may be learned through practice of the invention.

In a first example embodiment, a packaged terminal air conditioner unit includes a compressor positionable within a casing. The compressor is operable to increase a pressure of a refrigerant. An inlet conduit is coupled to the compressor at an accumulator of the compressor. An outlet conduit is coupled to the compressor at a discharge of the compressor. The discharge of the compressor is positioned at a top portion of the compressor. The outlet conduit extends upwardly along a vertical direction from the discharge of the compressor between a pair of angled segments of the inlet conduit. The pair of angled segments of the inlet conduit is positioned above the compressor along the vertical direction.

In a second example embodiment, a packaged terminal air conditioner unit includes a reversing valve and a rotary compressor that are positionable within a casing. The rotary compressor is operable to increase a pressure of a refrigerant. An inlet conduit is coupled to the rotary compressor at an accumulator of the rotary compressor. An outlet conduit is coupled to the rotary compressor at a discharge of the rotary compressor. The discharge of the rotary compressor is positioned at a top portion of the rotary compressor. The outlet conduit extends upwardly along a vertical direction from the discharge of the rotary compressor between a pair of angled segments of the inlet conduit. The pair of angled segments of the inlet conduit is positioned above the rotary compressor along the vertical direction. The accumulator of the rotary compressor is positioned between the reversing valve and the discharge of the rotary compressor along a horizontal direction that is perpendicular to the vertical direction.

In a third example embodiment, a packaged terminal air conditioner unit includes a reversing valve and a rotary compressor that are positionable within a casing. The rotary compressor is operable to increase a pressure of a refrigerant. An inlet conduit is coupled to the rotary compressor at an accumulator of the rotary compressor. An outlet conduit is coupled to the rotary compressor at a discharge of the rotary compressor. The discharge of the rotary compressor is positioned at a top portion of the rotary compressor. The outlet conduit extends upwardly along a vertical direction from the discharge of the rotary compressor. A pair of angled segments of the inlet conduit is positioned above the rotary compressor along the vertical direction. The accumulator of the rotary compressor is positioned between the reversing valve and the discharge of the rotary compressor along a horizontal direction that is perpendicular to the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
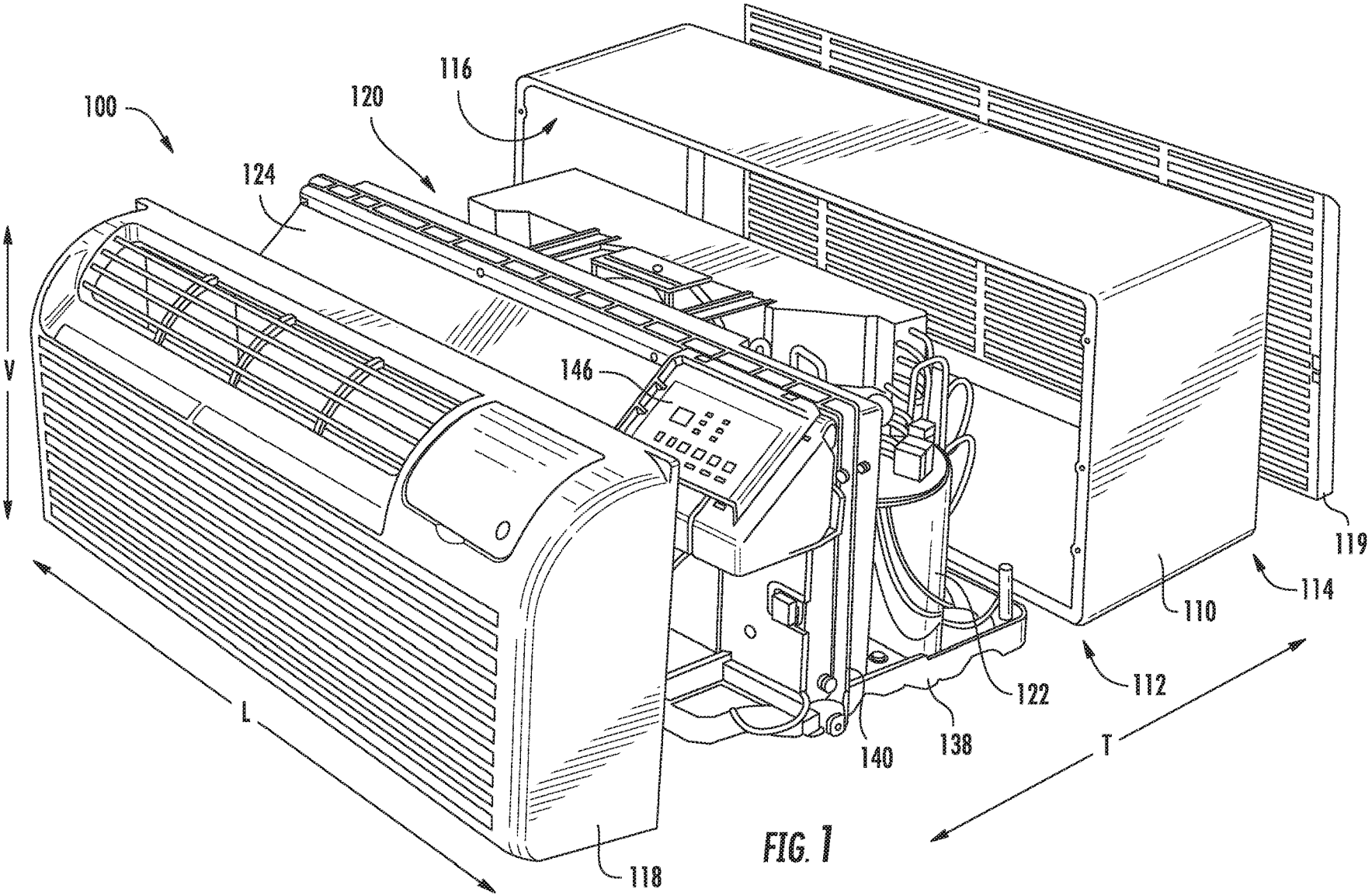
FIG. 1 is an exploded perspective view of a packaged terminal air conditioner unit according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an example embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air. Packaged terminal air conditioner unit 100 defines a vertical direction V, a lateral direction L and a transverse direction T that are mutually perpendicular and form an orthogonal direction system.

As used herein, the term "packaged terminal air conditioner unit" is used broadly. For example, packaged terminal air conditioner unit 100 may include a supplementary electric heater (not shown) for assisting with heating air within the associated room or building without operating the sealed system 120. However, as discussed in greater detail below, packaged terminal air conditioner unit 100 may also include a heat pump heating mode that utilizes sealed system 120, e.g., in combination with an electric resistance heater, to heat air within the associated room or building. Thus, it should be understood that "packaged terminal air conditioner unit" as used herein is intended to cover both units with and without heat pump heating modes.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 hinder or limit access to mechanical compartment 116 of casing 110. Front panel 118 is positioned at or adjacent interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall or bulkhead 140 positioned within mechanical compartment 116 of casing 110. Sealed system 120 is positioned on bottom tray 138. Thus, liquid runoff from sealed system 120 may flow into and collect within bottom tray 138. Bulkhead 140 may be mounted to bottom tray 138 and extend upwardly from bottom tray 138 to a top wall of casing 110. Bulkhead 140 limits or prevents air flow between interior side portion 112 of casing 110 and exterior side portion 114 of casing 110 within mechanical compartment 116 of casing 110. Thus, bulkhead 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
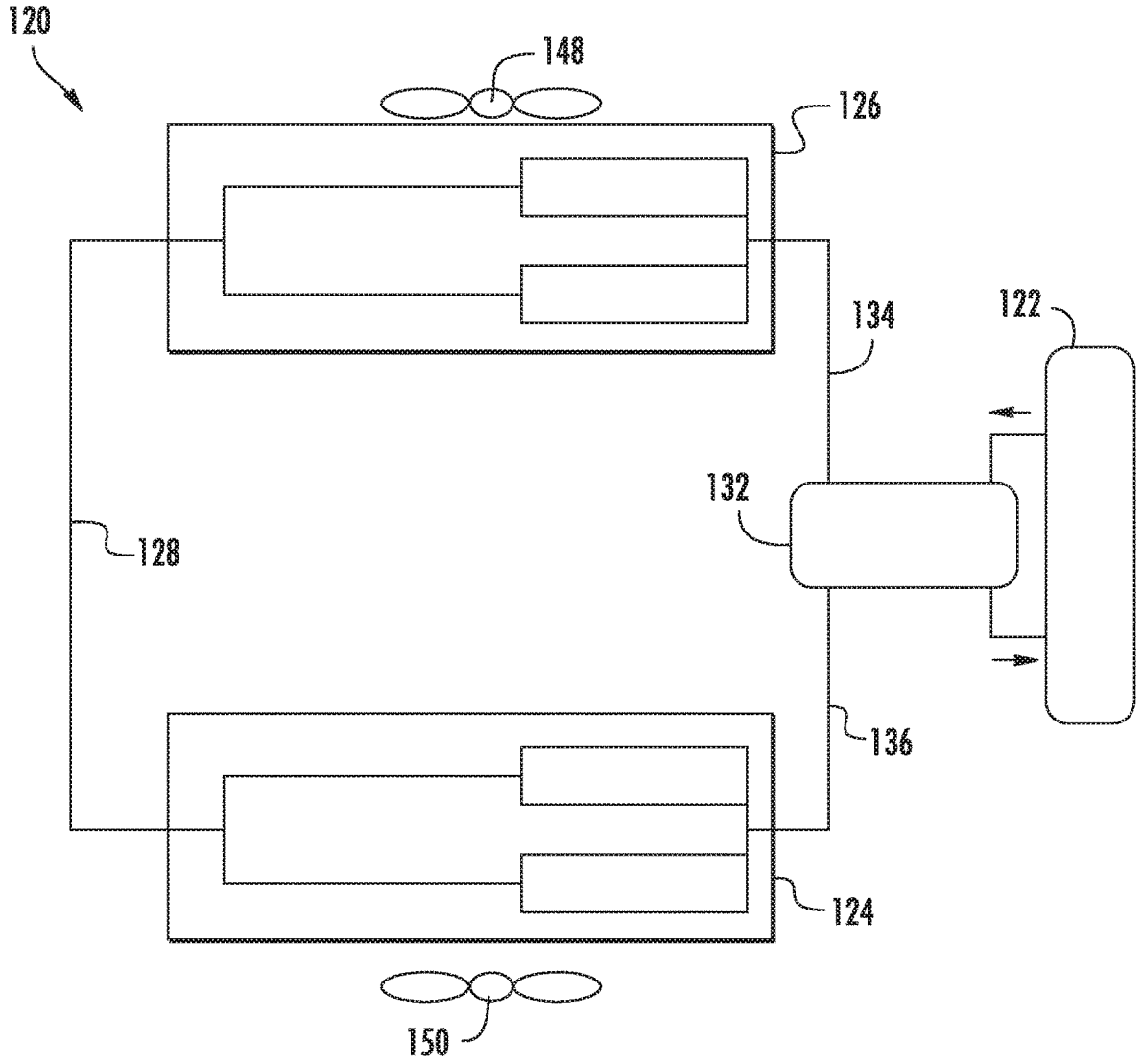
FIG. 2 is a schematic view of certain components of the example packaged terminal air conditioner unit of FIG. 1.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 may also include a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer.

Sealed system 120 also includes a capillary tube 128 disposed between interior coil 124 and exterior coil 126, e.g., such that capillary tube 128 extends between and fluidly couples interior coil 124 and exterior coil 126. Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from capillary tube 128 may enter interior coil 124 via a second distribution conduit 136 that extends between and fluidly connects interior coil 124 and reversing valve 132. Within interior coil 124, the refrigerant from capillary tube 128 receives energy from the interior atmosphere and vaporizes into superheated vapor and/or high quality vapor mixture. An interior air handler or fan 150 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of capillary tube 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative example embodiments, sealed system 120 may include any suitable components for heating and/or cooling air with a refrigerant. Sealed system 120 may also have any suitable arrangement or configuration of components for heating and/or cooling air with a refrigerant in alternative example embodiments.

Figure 3:
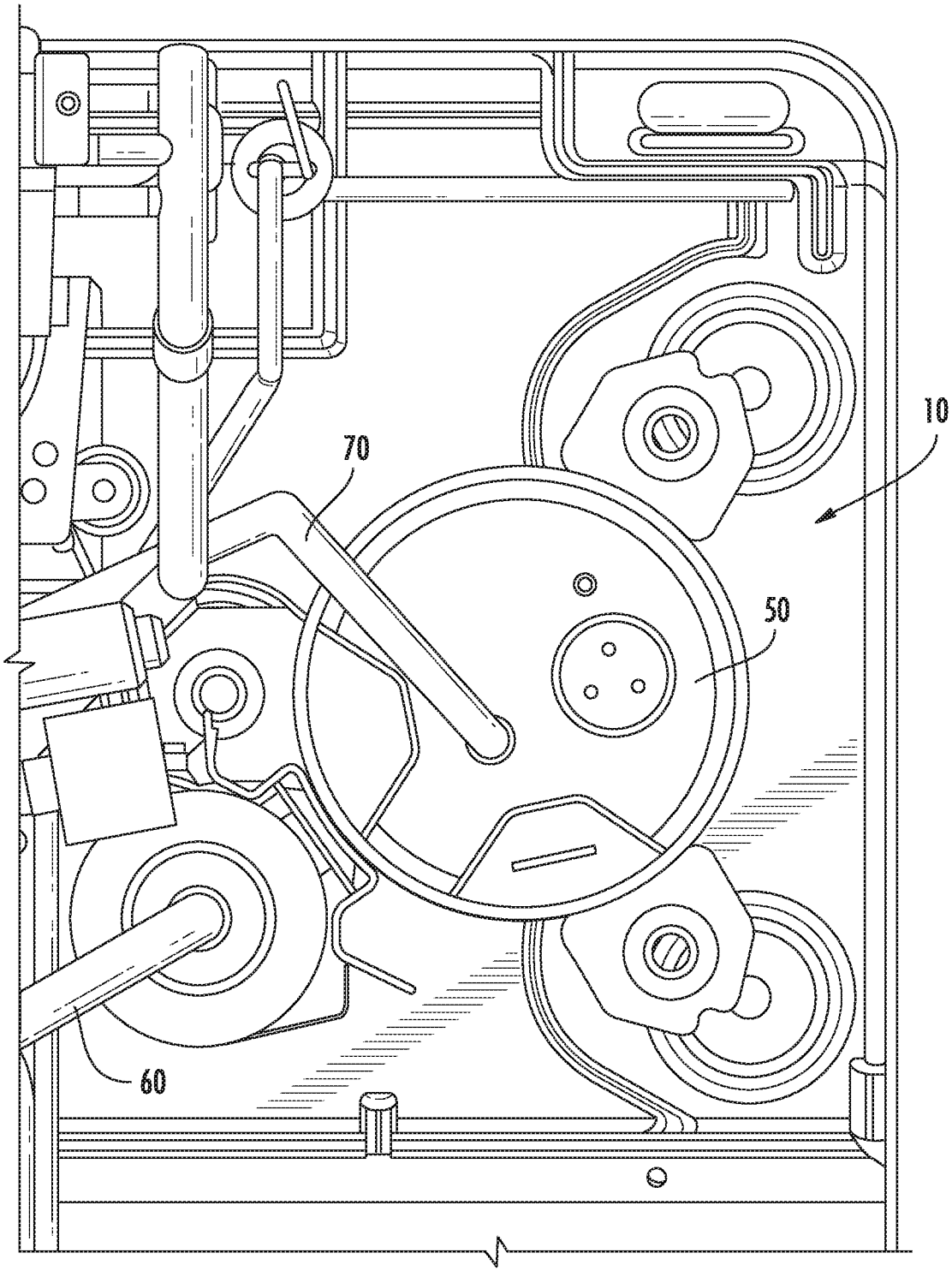
FIG. 3 is a top plan view of a known compressor, suction conduit and discharge conduit.
Figure 4:
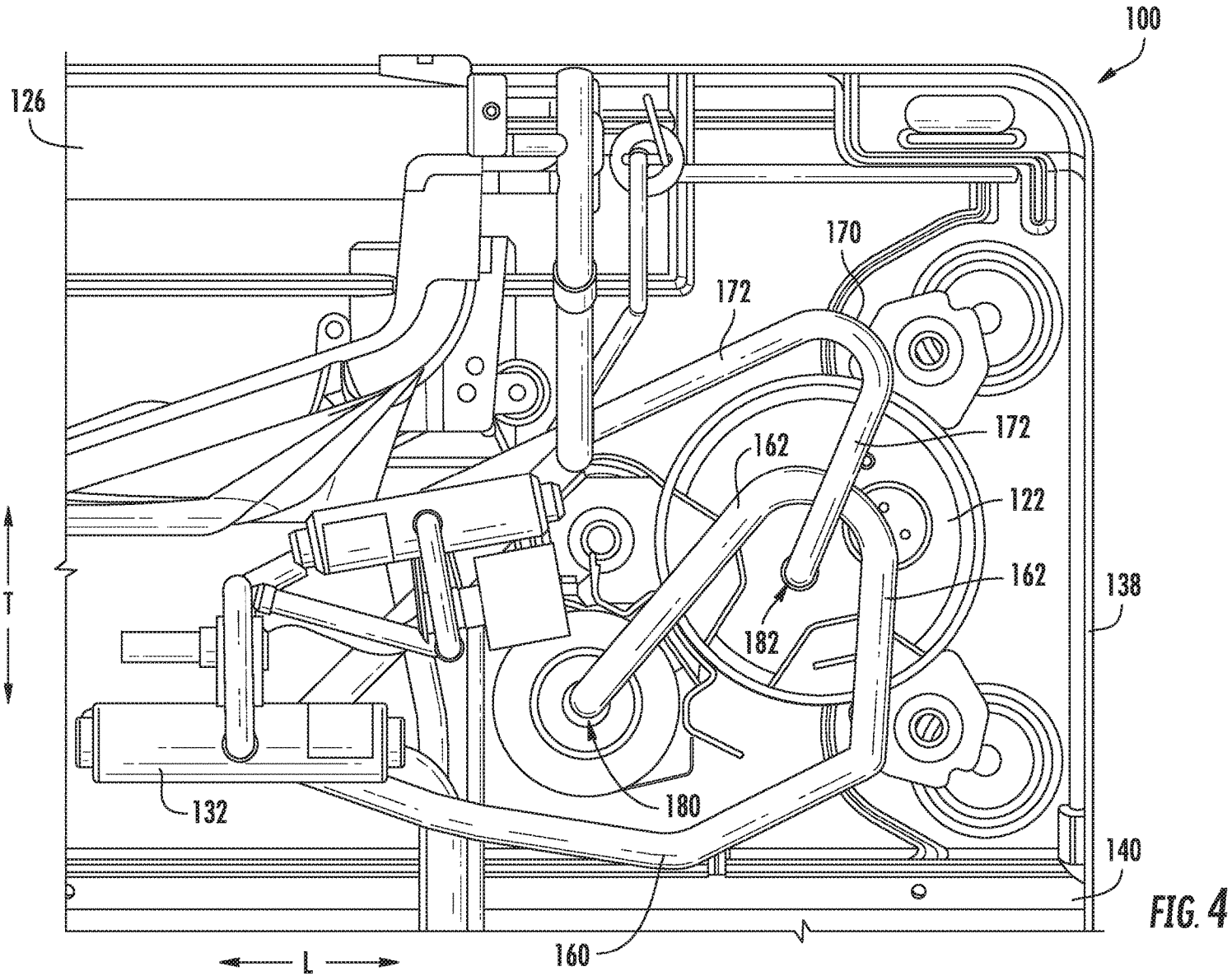
FIG. 4 is a partial top plan view of certain components of the example packaged terminal air conditioner unit of FIG. 1, including a compressor, an inlet conduit and an outlet conduit.
Figure 5:
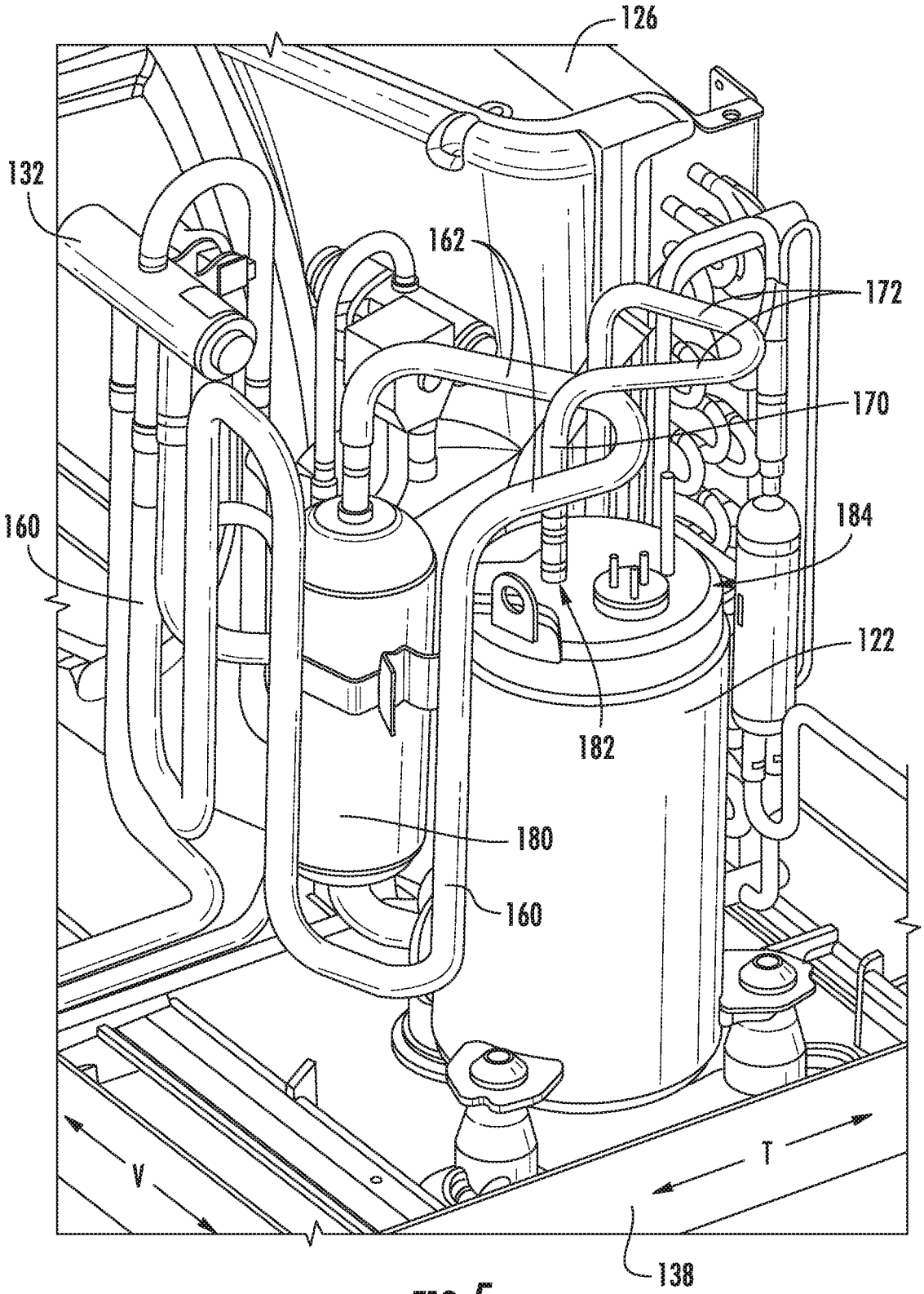
FIG. 5 is a partial perspective of the certain components of FIG. 5, including the compressor, the inlet conduit and the outlet conduit.

FIG. 4 is a partial top plan view of certain components of packaged terminal air conditioner unit 100, and FIG. 5 is a partial perspective view of such components of packaged terminal air conditioner unit 100. In particular, compressor 122, an inlet conduit 160 and an outlet conduit 170 are shown in FIGS. 4 and 5. As discussed in greater detail below, the lengths and orientations of inlet conduit 160 and outlet conduit 170 may be selected to reduce stiffness and better orient inlet conduit 160 and outlet conduit 170 to torsional excitement from compressor 122 relative to the known one-unit type air conditioner unit 10 shown in FIG. 3.

Compressor 122 may be a rotary compressor, such as a rotary vane compressor or a rolling piston compressor. Thus, e.g., compressor 122, inlet conduit 160 and outlet conduit 170 may collectively form a rotational vibration system, and the lengths and orientations of inlet conduit 160 and outlet conduit 170 may be selected such that inlet conduit 160 and/or outlet conduit 170 are less stiff compared to the suction conduit 60 and discharge conduit 70 in known one-unit type air conditioner unit 10. In particular, the lengths and orientations of inlet conduit 160 and outlet conduit 170 may be selected such that the rotational vibration system formed by compressor 122, inlet conduit 160 and outlet conduit 170 may resonate when compressor 122 operates at about fifteen hundred rotations per minute (~1500 RPM). As used herein, the term "about" means within ten percent of the stated frequency or speed when used in the context of compressor frequencies or speeds. Thus, packaged terminal air conditioner unit 100 may have a significantly reduced frequency at which the rotational vibration system formed by compressor 122, inlet conduit 160 and outlet conduit 170 resonates compared to known one-unit type air conditioner unit 10. The lengths and orientations of inlet conduit 160 and outlet conduit 170 shown in FIGS. 4 and 5 may soften a torsional spring constant of the rotational vibration system relative to the known one-unit type air conditioner unit 10 such that packaged terminal air conditioner unit 100 operates more quietly than known one-unit type air conditioner unit 10 at a normal operating speed of compressor 122.

As may be seen in FIGS. 4 and 5, inlet conduit 160 is coupled to compressor 122 at a muffler or accumulator 180 of compressor 122. Conversely, outlet conduit 170 is coupled to compressor 122 at a discharge 182 of compressor 122. Discharge 122 of compressor 122 is positioned at a top portion 184 of compressor 122. Compressor 122 is operable to increase the pressure of refrigerant between accumulator 180 and discharge 122. Thus, e.g., relatively low pressure refrigerant may flow from inlet conduit 160 into compressor 122 at accumulator 180, and relatively high pressure refrigerant may flow into outlet conduit 170 from compressor 122 at discharge 182. In certain example embodiments, accumulator 180 may be positioned horizontally (e.g., along a direction that is perpendicular to the vertical direction V) between reversing valve 132 and discharge 182.

Outlet conduit 170 extends upwardly along the vertical direction V from discharge 182 of compressor 122. In particular, outlet conduit 170 may extend, e.g., rectilinearly, upward along the vertical direction V from discharge 182 of compressor 122 between a pair of angled segments 162 of inlet conduit 160. The angled segments 162 of inlet conduit 160 are positioned above compressor 122, e.g., discharge 182 of compressor 122, along the vertical direction V. Accordingly, inlet conduit 160 may be hooked or looped around outlet conduit 170 above compressor 122. For example, outlet conduit 170 may be positioned between angled segments 162 of inlet conduit 160 in a plane that is perpendicular to the vertical direction V.

In certain example embodiments, inlet conduit 160 extends from reversing valve 132 to accumulator 180 of compressor 122. Thus, refrigerant may flow from reversing valve 132 to accumulator 180 through inlet conduit 160. Outlet conduit 170 may extend from discharge 182 of compressor 122 to reversing valve 132. Thus, refrigerant may flow from discharge 182 to reversing valve 132 through outlet conduit 170. In such a manner, inlet conduit 160 and outlet conduit 170 may flow refrigerant between compressor 122 and reversing valve 132. In certain example embodiments, inlet conduit 160 is bent into a serpentine pattern between reversing valve 132 and angled segments 162 of inlet conduit 160, e.g., in the manner shown in FIG. 5. Thus, inlet conduit 160 may have an increased length between reversing valve 132 and angled segments 162 of inlet conduit 160 relative to a rectilinear or straight conduit. The increased length and serpentine shaping of the inlet conduit 160 between reversing valve 132 and angled segments 162 of inlet conduit 160 may advantageously decrease the stiffness of inlet conduit 160 relative to a straight conduit.

Outlet conduit 170 may also have a pair of angled segments 172. Thus, outlet conduit 170 may have an increased length between discharge 182 and reversing valve 132 relative to a rectilinear or straight conduit. The increased length of outlet conduit 170 between discharge 182 and reversing valve 132 and the shaping of angled segments 172 of outlet conduit 170 may advantageously decrease the stiffness of outlet conduit 170 relative to a straight conduit. Angled segments 172 of outlet conduit 170 may be positioned above angled segments 162 of inlet conduit 160 along the vertical direction V. Thus, angled segments 172 of outlet conduit 170 may also be positioned above compressor 122 along the vertical direction V.

Inlet and outlet conduits 160, 170 may be metal tubing, such as copper or aluminum tubing. Thus, inlet and outlet conduits 160, 170 may be bent into the shapes and orientations shown in FIGS. 4 and 5. For example, inlet conduit 160 may be bent such that inlet conduit 160 is V-shaped at angled segments 162 of inlet conduit 160, and angled segments 162 of inlet conduit 160 may be positioned coplanar with each other in a plane that is about perpendicular to the vertical direction V. As used herein the term "about" means within ten degrees of the stated angle when used in the context of plane angles. As an example, inlet conduit 160 may be bent such that angled segments 162 of inlet conduit 160 define an angle no less than twenty degrees (20°) and no greater than eighty degrees (80°) between angled segments 162.

Outlet conduit 170 may also be bent such that outlet conduit 170 is V-shaped at angled segments 172 of outlet conduit 170, and angled segments 162 of inlet conduit 160 may be positioned coplanar with each other in a plane that is perpendicular to the vertical direction V (a different plane than the angled segments 162 of inlet conduit 160). As an example, outlet conduit 170 may be bent such that angled segments 172 of outlet conduit 170 define an angle no less than twenty degrees (20°) and no greater than eighty degrees (80°) between angled segments 172. In addition, the open end of the V-shaped angled segments 172 of outlet conduit 170 may be oriented and open towards reversing valve 132 and/or accumulator 180, as shown in FIG. 4.

By hooking or looping the inlet and outlet conduits 160, 170 over the top portion 184 of compressor 122, the angle at which inlet and outlet conduits 160, 170 leave compressor 122 radially may be adjusted relative to the known one-unit type air conditioner unit 10. Also, hooking or looping the inlet and outlet conduits 160, 170 over the top portion 184 of compressor 122 adds length to inlet and outlet conduits 160, 170 and reduces the stiffness of the inlet and outlet conduits 160, 170 relative to the known one-unit type air conditioner unit 10. In such a manner, packaged terminal air conditioner unit 100 may operate more quietly than the known one-unit type air conditioner unit 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:
a compressor positionable within a casing, the compressor operable to increase a pressure of a refrigerant;
an inlet conduit coupled to the compressor at an accumulator of the compressor the inlet conduit having a pair of angled segments; and
an outlet conduit coupled to the compressor at a discharge of the compressor, the discharge of the compressor positioned at a top portion of the compressor,
wherein the outlet conduit extends upwardly along a vertical direction from the discharge of the compressor between and over the pair of angled segments of the inlet conduit, the pair of angled segments of the inlet conduit positioned above the compressor along the vertical direction,
wherein the outlet conduit has a pair of angled segments positioned above the pair of angled segments of the inlet conduit along the vertical direction,
wherein the inlet conduit is bent such that the inlet conduit is V-shaped at the pair of angled segments of the inlet conduit, and
wherein the angled segments of the pair of angled segments of the inlet conduit are positioned coplanar with each other in a first plane that is about perpendicular to the vertical direction,
wherein the outlet conduit is bent such that the outlet conduit is V-shaped at the pair of angled segments of the outlet conduit, and
wherein the angled segments of the pair of angled segments of the outlet conduit are positioned coplanar with each other in a second plane that is about perpendicular to the vertical direction.

2. The packaged terminal air conditioner unit of claim 1, further comprising a reversing valve, the inlet conduit extending from the reversing valve to the accumulator of the compressor, the outlet conduit extending from the discharge of the compressor to the reversing valve.

3. The packaged terminal air conditioner unit of claim 2, wherein the inlet conduit is bent into a serpentine pattern between the reversing valve and the pair of angled segments of the inlet conduit.

4. The packaged terminal air conditioner unit of claim 1, wherein the compressor is a rotary compressor.

5. A packaged terminal air conditioner unit, comprising:

a reversing valve positionable within a casing;

a rotary compressor positionable within the casing, the rotary compressor operable to increase a pressure of a refrigerant;

an inlet conduit coupled to the rotary compressor at an accumulator of the rotary compressor, the inlet conduit having a pair of angled segments; and an outlet conduit coupled to the rotary compressor at a discharge of the rotary compressor, the discharge of the rotary compressor positioned at a top portion of the rotary compressor, wherein the outlet conduit extends upwardly along a vertical direction from the discharge of the rotary compressor between and over the pair of angled segments of the inlet conduit, the pair of angled segments of the inlet conduit positioned above the rotary compressor along the vertical direction, wherein the accumulator of the rotary compressor is positioned between the reversing valve and the discharge of the rotary compressor along a horizontal direction that is perpendicular to the vertical direction, wherein the outlet conduit has a pair of angled segments positioned above the pair of angled segments of the inlet conduit along the vertical direction, wherein the inlet conduit is bent such that the inlet conduit is V-shaped at the pair of angled segments of the inlet conduit, wherein the angled segments of the pair of angled segments of the inlet conduit are positioned coplanar with each other in a first plane that is about perpendicular to the vertical direction, wherein the outlet conduit is bent such that the outlet conduit is V-shaped at the pair of angled segments of the outlet conduit, and wherein the angled segments of the pair of angled segments of the outlet conduit are positioned coplanar with each other in a second plane that is about perpendicular to the vertical direction.

6. The packaged terminal air conditioner unit of claim 5, wherein the inlet conduit extends from the reversing valve to the accumulator of the rotary compressor, the outlet conduit extending from the discharge of the rotary compressor to the reversing valve.

7. The packaged terminal air conditioner unit of claim 6, wherein the inlet conduit is bent into a serpentine pattern between the reversing valve and the pair of angled segments of the inlet conduit.

* * * * *